US012693092B2

(12) United States Patent
Chen et al.

(10) Patent No.: US 12,693,092 B2
(45) Date of Patent: Jul. 28, 2026

(54) PRESSURIZED GAS VESSEL AND PIERCING MECHANISM

(71) Applicant: BANZA STAMPING INDUSTRY CORP, Su'ao Township (TW)

(72) Inventors: Li-Wei Chen, Su'ao Township (TW); Tsang-Yao Lu, Su'ao Township (TW); Min-Yan Xie, Su'ao Township (TW)

(73) Assignee: BANZA STAMPING INDUSTRY CORPORATION, Su'ao Township (TW)

( * ) Notice: Subject to any disclaimer, the term of this patent is extended or adjusted under 35 U.S.C. 154(b) by 0 days.

(21) Appl. No.: 18/666,354

(22) Filed: May 16, 2024

(65) Prior Publication Data

US 2024/0418475 A1 Dec. 19, 2024

Related U.S. Application Data

(63) Continuation-in-part of application No. 29/896,694, filed on Jul. 6, 2023, now Pat. No. Des. 1,101,898.

(30) Foreign Application Priority Data

Jun. 19, 2023 (TW) ..... 112303076

(51) Int. Cl.
*F41B 11/62* (2013.01)
*F41B 11/73* (2013.01)

(52) U.S. Cl.
CPC ..... *F41B 11/62* (2013.01); *F41B 11/73* (2013.01)

(58) Field of Classification Search
CPC ..... F41B 11/62; F41B 11/723; F41B 11/57; F41B 11/721; F41B 11/64; F41B 11/71; F41B 11/724; F41B 11/54; F41B 11/73; F41B 11/00
See application file for complete search history.

(56) References Cited

U.S. PATENT DOCUMENTS 127,873 A * 6/1872 Hannah ..... F41A 21/08 124/58
749,519 A * 1/1904 Benjamin ..... F41B 11/72 124/73
1,191,877 A * 7/1916 Dickey ..... F41B 11/72 124/76
1,366,577 A * 1/1921 Mahern ..... F41B 7/00 124/56

(Continued)

FOREIGN PATENT DOCUMENTS

DE 2 552 988 A 2/2018
TW 201 713 574 A 4/2017
WO WO 2017/156186 A2 9/2017

*Primary Examiner* — Michael D David
(74) *Attorney, Agent, or Firm* — Mark A. Pitchford; Eric B. Fugett; Pitchford Fugett, PLLC

(57) ABSTRACT

High pressure compressed gas pressure vessels and devices utilizing such vessels are disclosed herein. More particularly, aspects of the present invention are directed to high pressure (i.e., nitrogen or N2 based) pressurized gas cylinders with pierceable membranes recessed from the opening of the pressure vessel such that prior art piercing mechanisms cannot pierce the membrane for safety purposes. Additionally, aspects of the present invention are directed to pressurized gas operated devices with elongated pins for piercing pressure vessels with recessed pierceable membranes.

6 Claims, 7 Drawing Sheets

(56) References Cited

U.S. PATENT DOCUMENTS 2,605,756 A * 8/1952 Bertschinger ..... F41B 11/647 124/58
4,865,009 A * 9/1989 Ford ..... F41B 11/723 124/76
4,986,251 A * 1/1991 Lilley ..... F41B 11/54 124/52
5,186,156 A * 2/1993 Clayton ..... F41B 11/54 124/66
5,193,517 A * 3/1993 Taylor ..... F41B 11/64 124/67
5,727,538 A * 3/1998 Ellis ..... F41B 11/52 124/32
6,053,157 A * 4/2000 Frank ..... F41B 11/00 114/238
6,089,139 A * 7/2000 Russell ..... F41B 11/00 89/14.05
6,543,365 B1 * 4/2003 Vasel ..... F41B 11/62 102/370
6,581,585 B2 * 6/2003 Nibecker, Jr. ..... F41B 11/723 124/76
6,708,685 B2 * 3/2004 Masse ..... F41B 11/724 124/75
6,874,492 B1 * 4/2005 Schavone ..... F41B 11/721 124/31
6,901,689 B1 * 6/2005 Bergstrom ..... F41A 3/92 42/1.06
7,086,393 B1 * 8/2006 Moss ..... F41B 11/723 124/70
7,287,527 B1 * 10/2007 Piper ..... F41B 11/50 124/75
8,322,329 B1 * 12/2012 Sikes ..... F41B 11/723 124/73
9,664,475 B1 * 5/2017 Maggiore ..... F41B 11/54
10,451,379 B2 * 10/2019 Heckert ..... F41A 19/16
2002/0100361 A1 * 8/2002 Russell ..... F41B 11/00 89/14.5
2002/0178901 A1 * 12/2002 Bergstrom ..... F41A 25/20 89/198
2003/0047105 A1 * 3/2003 Vasel ..... F41B 11/57 102/502
2003/0056778 A1 * 3/2003 Schavone ..... F41B 11/721 124/74
2005/0188886 A1 * 9/2005 Vasel ..... F41B 11/57 102/502
2007/0017497 A1 * 1/2007 Masse ..... F41B 11/73 124/73
2007/0175324 A1 * 8/2007 Adams ..... F41B 11/721 89/7
2008/0078369 A1 * 4/2008 Yeung ..... F41B 11/64 124/67
2008/0078769 A1 4/2008 Crunkleton, III
2009/0241931 A1 * 10/2009 Masse ..... F41B 11/71 124/76
2010/0286791 A1 * 11/2010 Goldsmith ..... A61B 17/12022 604/524
2011/0017188 A1 * 1/2011 Call ..... F41B 11/723 124/73
2011/0088676 A1 * 4/2011 Maruyama ..... F41B 11/721 124/82
2013/0214526 A1 * 8/2013 Annuzzi, Jr. ..... F41B 11/62 285/93
2016/0153741 A1 * 6/2016 Axelsson ..... F41B 11/723 124/73
2017/0059090 A1 3/2017 Bopp
2017/0336169 A1 * 11/2017 Axelsson ..... F41B 11/62
2018/0274728 A1 * 9/2018 Dos Passos ..... F41B 11/62
2019/0023414 A1 * 1/2019 Palmer ..... B64F 1/025
2020/0132412 A1 * 4/2020 Pedicini ..... F41B 11/64
2021/0108879 A1 * 4/2021 Clemons ..... F41B 11/643
2022/0099404 A1 * 3/2022 Sullivan ..... F41B 11/721
2022/0170720 A1 * 6/2022 Clemons ..... F41H 9/10
2022/0276020 A1 * 9/2022 Sullivan ..... F41B 11/721
2023/0184507 A1 * 6/2023 Ash ..... F41B 11/62 124/56
2024/0085145 A1 * 3/2024 Porat ..... F41B 11/648
2024/0302129 A1 * 9/2024 Du Plessis ..... F41B 11/723
2024/0418475 A1 * 12/2024 Chen ..... F41B 11/62
2024/0418476 A1 * 12/2024 Chen ..... F41B 11/73

* cited by examiner

PRESSURIZED GAS VESSEL AND PIERCING MECHANISM

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCE TO RELATED APPLICATIONS

This application claims priority to Taiwanese Design patent application Ser. No. 11/230,3076 filed Jun. 19, 2023 and U.S. Design patent application Ser. No. 29/896,694 filed Jul. 6, 2023.

FEDERALLY SPONSORED RESEARCH AND DEVELOPMENT

Not Applicable

BACKGROUND OF THE INVENTION

The present invention relates generally to pressurized gas vessels. More particularly, this invention pertains to high pressure gas vessels and tapping systems and methods for high pressure gas vessels.

Mass produced, single use compressed carbon dioxide (CO2) gas cylinders are used in a number of applications including airguns, model airplanes, model cars, and portable soda machines. Although referred to as pressurized gas cylinders, these pressure vessels typically contain a mixture of liquid and gaseous CO2 in equilibrium at operating pressures of about 800-900 psi for a 12 g CO2 cartridge depending on the temperature. These pressure vessels are typically made up of a cylinder that necks down at one end and includes threads around the neck. The cylinder is filled and closed with a cap having a relatively thin membrane at the outer surface of the cap (i.e., even with the opening of the cylinder neck). When the cylinder is screwed into a device (i.e., airgun, model plane, model car, portable soda machine, etc.), an o-ring seals about the neck of the cylinder and a pin fixed in place inside the device pierces the membrane of the cap, allowing the pressurized gas into the device for use by the device. These single use cylinders pressurized CO2 cartridges come in a variety of standardized sizes.

There is a desire for higher pressure cartridges such that devices operated by compressed air can be more powerful or deliver more regulated energy over time with each cartridge. Nitrogen (N2) liquid/gas pressure vessels operate at about 3600 psi in common ambient temperatures (i.e., about 21 C). Thus, devices operating on nitrogen gas can be 3-4 times more powerful than CO2 operated devices, or devices can run 3-4 times longer on a cylinder of a given size. However, because the pressures of N2 cartridges are so much higher than CO2 cartridges, N2 cartridges inserted into a device designed for CO2 cartridges can result in catastrophic failure, potentially causing injuries to users. Additionally, it can be impossible to fully seat (e.g., screw in) an N2 cartridge in a prior art CO2 cartridge style housing because of back pressure when the pin in the device partially pierces the N2 cartridge membrane. At 3-4 times the back pressure, once pierced, a user may not be able to screw the cartridge into the housing further to get the pin fully through the membrane such that gas flow from the cartridge to the device may be insufficient in such a partial piercing scenario. Thus, piercing N2 cartridges with prior art housings and pins is both unreliable and dangerous.

SUMMARY OF THE INVENTION

Aspects of the present invention are directed to compressed gas pressure vessels and devices utilizing such vessels. More particularly, aspects of the present invention are directed to high pressure (i.e., N2 based) pressurized gas cylinders with pierceable membranes recessed from the opening of the pressure vessel such that prior art piercing mechanisms cannot pierce the membrane for safety purposes. Additionally, aspects of the present invention are directed to pressurized gas operated devices with elongated pins for piercing pressure vessels with recessed pierceable membranes.

In one aspect, a pressure vessel includes a hollow body and a cap. The hollow body has an opening. The cap includes a shoulder, a sidewall, and a membrane. The shoulder has a bottom surface configured to abut the hollow body about the opening in the hollow body when the pressure vessel is assembled. The shoulder is generally planar having a hole therethrough. The sidewall extends longitudinally and perpendicularly from the bottom surface of the shoulder about the hole. The sidewall has a central opening. The membrane closes off the central opening. The membrane is longitudinally offset from the shoulder (e.g., at an opposite end of the sidewall from the shoulder).

In another aspect, a piercing mechanism for a pressure vessel includes a pin, a housing, and a pressure vessel seal. The pin is configured to pierce the membrane of the pressure vessel. The membrane is recessed from the surface of the pressure vessel within a generally cylindrical central opening of the pressure vessel. The pin includes an upper portion at a top of the pin, a lower portion at a bottom of the pan, and a longitudinal passage extending longitudinally through the pin. The housing is configured to receive the pin and a neck of the pressure vessel, line the pin with the central opening of the pressure vessel, and control longitudinal movement of the pressure vessel. The pressure vessel seal is configured to seal between the neck of the pressure vessel and the housing when the neck of the pressure vessel is received in the housing. The lower portion of the pin has a width smaller than the width of the membrane of the pressure vessel and extends longitudinally further than the membrane is recessed from the surface of the pressure vessel.

In another aspect, an airgun including a piercing mechanism for a pressure vessel. The piercing mechanism for a pressure vessel includes a pin, a housing, and a pressure vessel seal. The pin is configured to pierce the membrane of the pressure vessel. The membrane is recessed from the surface of the pressure vessel within a generally cylindrical central opening of the pressure vessel. The pin includes an upper portion at a top of the pin, a lower portion at a bottom of the pan, and a longitudinal passage extending longitudinally through the pin. The housing is configured to receive the pin and a neck of the pressure vessel, line the pin with the central opening of the pressure vessel, and control longitudinal movement of the pressure vessel. The pressure vessel seal is configured to seal between the neck of the pressure vessel and the housing when the neck of the pressure vessel is received in the housing. The lower portion of the pin has a width smaller than the width of the membrane of the pressure vessel and extends longitudinally further than the membrane is recessed from the surface of the pressure vessel.

BRIEF DESCRIPTION OF DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
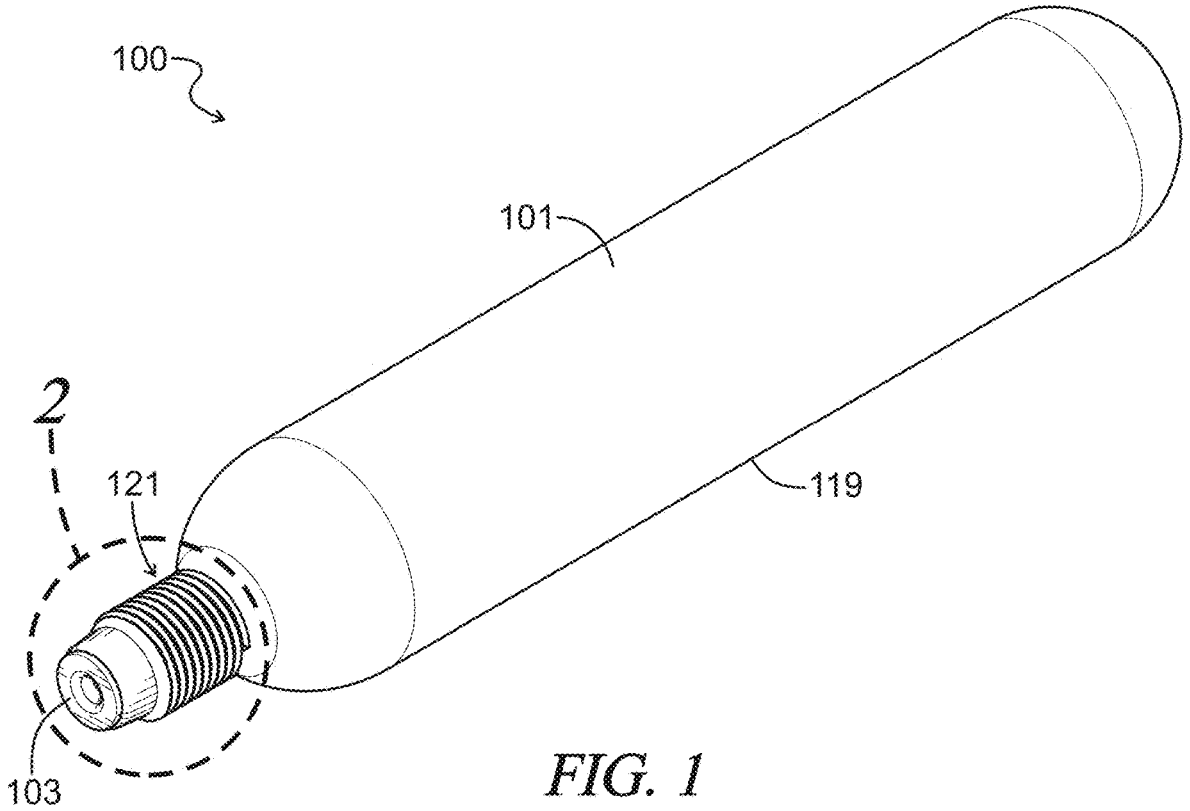
FIG. 1 is an isometric view of a pressure vessel according to one embodiment of the invention.
Figure 2:
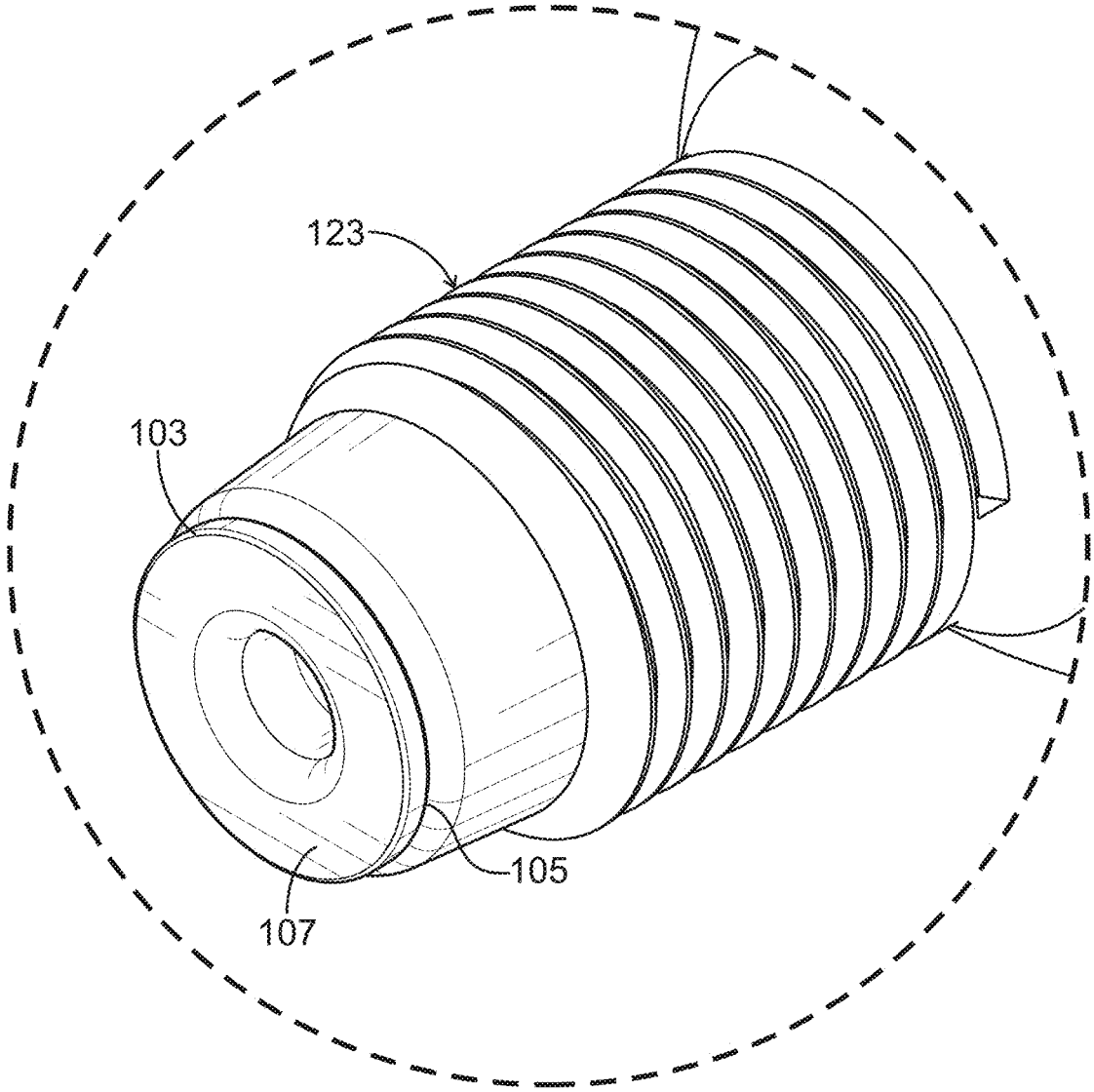
FIG. 2 is an enlarged isometric view of the highlighted segment of the pressure vessel of FIG. 1.
Figure 3:
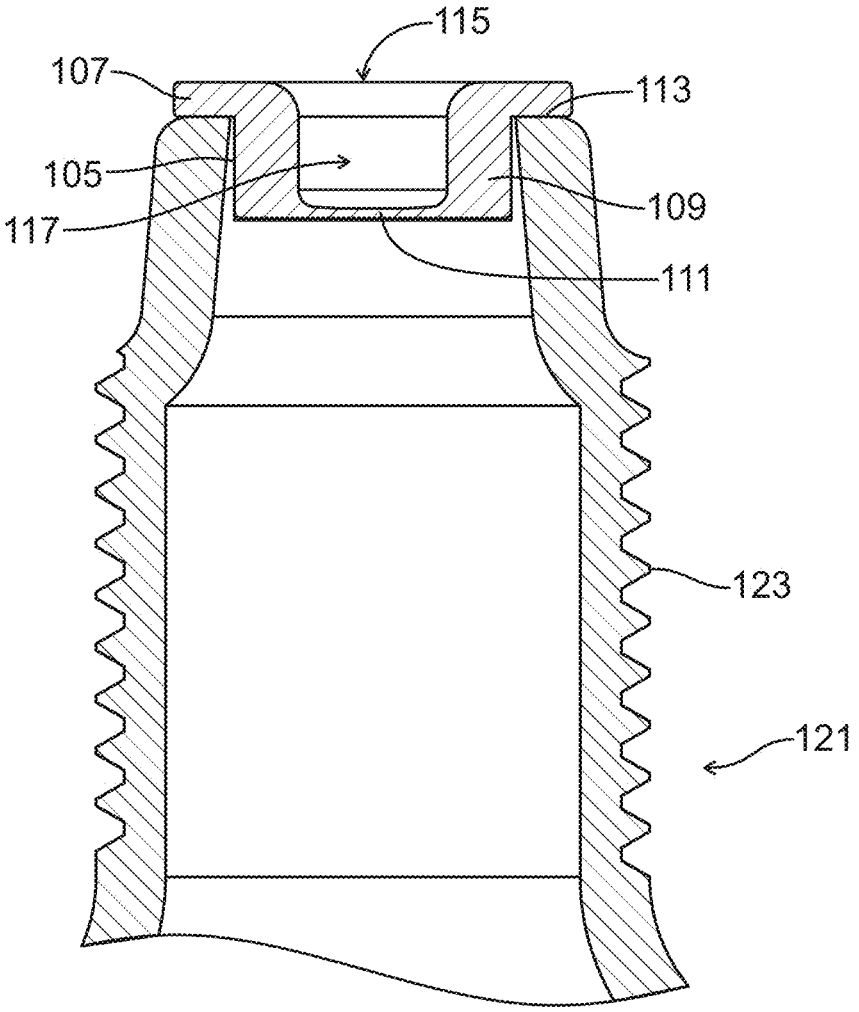
FIG. 3 is a side cutaway view of the neck of the pressure vessel of FIG. 1.
Figure 4:
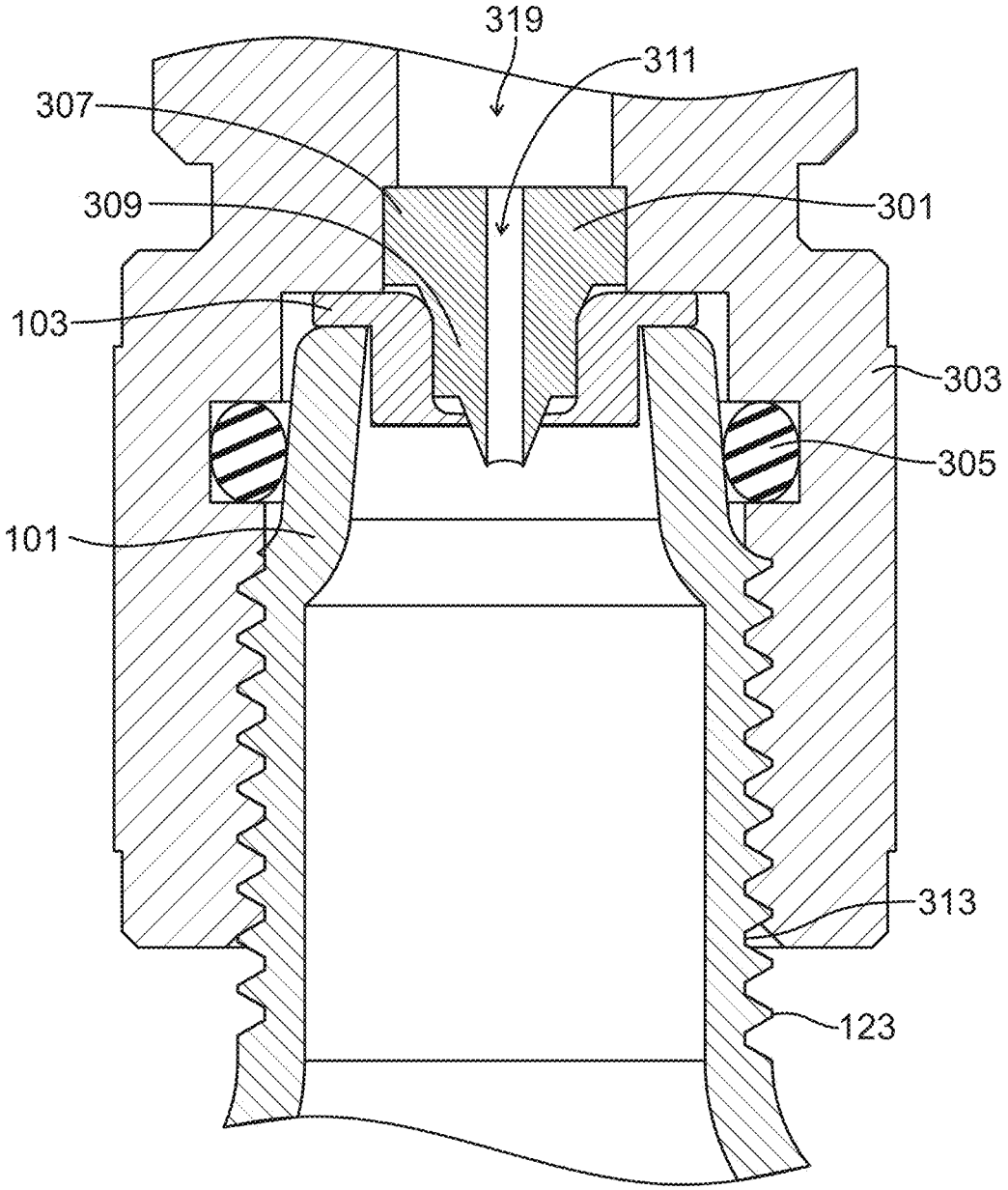
FIG. 4 is a side cutaway view of the pressure vessel of FIG. 1 inserted into a piercing mechanism according to another embodiment of the invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. As used herein, the upright or vertical position of a gun or firearm is when assembled and with the opening of the pressure vessel at a top of the pressure vessel such that the neck and piercing mechanism extend generally vertically along a longitudinal axis. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

Referring now to FIGS. 1-7, a pressure vessel 100 includes a hollow body 101, and a cap 103. The hollow body 101 has an opening 105. In one embodiment, the pressure vessel 100 is formed of metal such as steel.

The cap 103 includes a shoulder 107, a sidewall 109, and a membrane 111. The shoulder 107 has a bottom surface 113 configured to abut the hollow body 101 about the opening 105 in the hollow body 101 when the pressure vessel 100 is assembled. The shoulder 107 is generally planar having a hole 115 therethrough. The sidewall 109 extends longitudinally and perpendicularly from the bottom surface 113 of the shoulder 107 about the hole 115. The sidewall 109 has a central opening 117. The membrane 111 closes off the central opening 117, and the membrane 111 is longitudinally offset from the shoulder 107. In one embodiment, the shoulder 107 and membrane 111 are at opposing ends of the sidewall 109. In one embodiment, the shoulder 107 and sidewall 109 are generally annular and the membrane 111 is disc shaped. In one embodiment, the pressure vessel 100 contains a mixture of liquid and gaseous nitrogen (i.e., N2) when assembled and the cap 103 is welded to the hollow body 101. In one embodiment, the hollow body 101 is generally cylindrical with a rounded bottom end and a necked down top end. In one embodiment, the hole 115 through the shoulder 107 is generally circular, the central opening 117 is generally circular, the shoulder 107 is generally circular, and the membrane 111 is generally circular and planar.

In one embodiment, the hollow body 101 includes a generally cylindrical main body 119 extending longitudinally. The hollow body 101 also includes a neck 121 extending from the main body 119, and the neck 121 has threads 123 thereon. The neck 121 has a small diameter than the main body 119. The neck 121 is at a top of the main body 119, and the bottom of the main body 119 is generally rounded. The neck 121 and threads 123 are integral with the main body 119.

When the pressure vessel 100 is assembled (i.e., containing pressurized gas over liquid such as N2), the sidewall 109 extends into the opening 105, and the bottom surface 113 of the shoulder 107 is affixed (e.g., welded) to the top of the opening 105 in the neck 121 of the pressure vessel 100. The membrane 111 is thus recessed into the opening 105 and neck 121 of the pressure vessel 100 such that the membrane 111 is protected and not reachable by conventional piercing mechanisms or pins in prior art compressed CO2 driven devices (e.g., airguns). In one embodiment, the central opening 117 in the sidewall has a diameter equal to the diameter of the hole 115 through the shoulder 107 and the membrane 111. In one embodiment, the membrane 111 is longitudinally thinner than the shoulder 107 is and than the sidewall 109 is radially. That is, the membrane 111 is the thinnest portion of the pressure vessel 100.

A piercing mechanism for the pressure vessel 100 includes a pin 301, a housing 303, and a pressure vessel seal 305. The pin 301 is configured to pierce the membrane 111 of the pressure vessel 100. That is, the pin 301 has a diameter slightly smaller than the diameter of the central opening 117 in the sidewall 109 and is elongated to reach down from the shoulder 109 of the cap 103 to (and through) the membrane 111 when the pressure vessel 100 is received in the piercing mechanism (i.e., put in a compressed air driven device incorporating the piercing mechanism). The pin 301 includes an upper portion 307 at top of the pin 301, a lower portion 309 at a bottom of the pin 301, and a longitudinal passage 311 extension longitudinally through the pin 301.

The housing 303 is configured to receive the pin 301 and the neck 121 of the pressure vessel 100. In one embodiment, the housing 303 has threads 313 complementing the threads 123 on the neck 121 of the pressure vessel 100. The housing 303 is configured to align the pin 301 with the central opening 117 of the pressure vessel 100 and control longitudinal movement of the pressure vessel 100 when the pressure vessel 100 is received in the housing 303 (e.g., when the pressure vessel 100 is screwed into the housing 303). In other words, the threads 123, 313 cooperate to move the pressure vessel 100 longitudinally relative to the housing 303 as the threads 123, 313 are screwed together or apart.

The pressure vessel seal 305 is configured to seal between the neck 121 of the pressure vessel 100 and the housing 303 when the neck 121 of the pressure vessel 100 is received in the housing 303.

The lower portion 309 of the pin 301 has a width smaller than the width of the membrane 111 of the pressure vessel 100 and extends longitudinally farther than the membrane 111 is recessed from the surface of the pressure vessel 100. That is, the lower portion 309 of the pin 301 is configured to extend down into the 103 and pierce the membrane 111 when the pressure vessel 100 is seated in the housing 303. In one embodiment, the lower portion 309 of the pin 301 narrows to a point distal from the upper portion 307 of the pin 301 with the longitudinal passage 311 extending through the point (e.g., the point of the lower portion 309 of the pin 301 is conical or needlelike).

In one embodiment, the housing 303 is configured to receive pressurized gas from the pressure vessel 100 via the pin 301 when the pin 301 pierces the pressure vessel 100. The housing 303 further includes a conduit 319 configured to receive the pressurized gas from the pressure vessel 100 via the longitudinal passage 311 and the cavity 117 when the pin 301 pierces the pressure vessel 100. The conduit 319 is how a device utilizing the pressurized gas from the pressure vessel 100 receives the pressurized gas from the housing 303 of the piercing mechanism.

Figure 5:
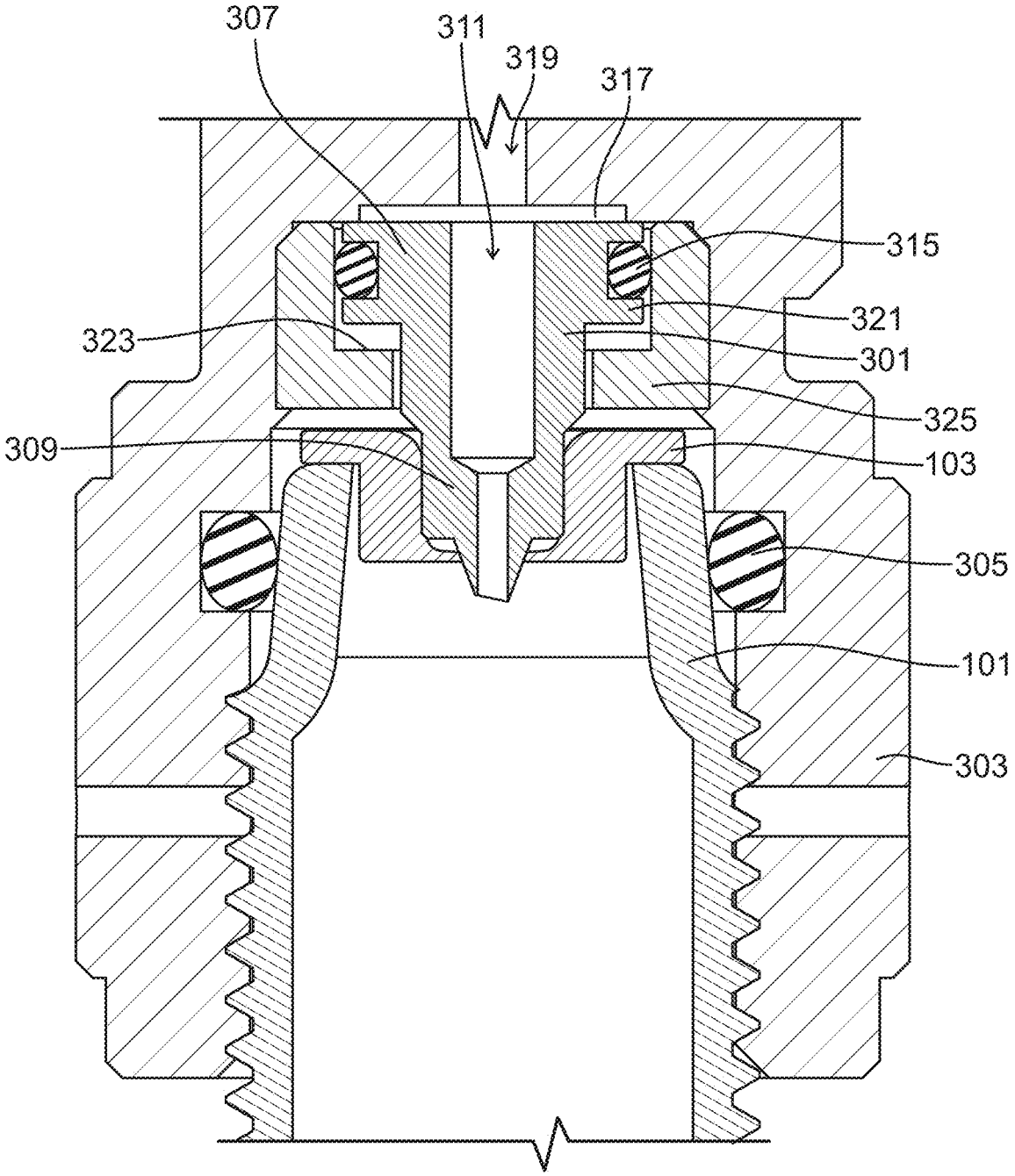
FIG. 5 is a side cutaway view of the neck of the pressure vessel of FIG. 1 inserted into a piercing mechanism with a movable pin according to another embodiment of the invention.

Referring particularly to FIG. 5, in one embodiment, the piercing mechanism further includes an upper pin seal 315 configured to seal between the upper portion 307 of the pin 301 and the housing 303. The upper portion 307 of the pin 301 has a larger diameter than the lower portion 309 of the pin 301. The pin 301 is movable longitudinally relative to the housing 303 such that when the lower portion 309 of the pin 301 pierces the membrane 111 of the pressure vessel 100, pressurized gas from the pressure vessel 100 travels through the longitudinal passage 311 and cavity 317 between the top of the pin 301 and the housing 303 such that the pressurized gas pushes the pin 301 further into the pressure vessel 100. The longitudinal passage 311 extends down through the lower portion 309 of the pin 301 and up through the upper portion 307 of the pin 301 to fluidly connect an interior of the pressure vessel 100 to the cavity 317 between the top of the pin 301 and the housing 303 when the pressure vessel 100 is received in the housing 303. In one embodiment, the pressurized gas entering the cavity 317 between the top of the pin 301 and the housing 303 pushes the pin 301 longitudinally down relative to the housing 303 and pressure vessel 100.

Figure 6:
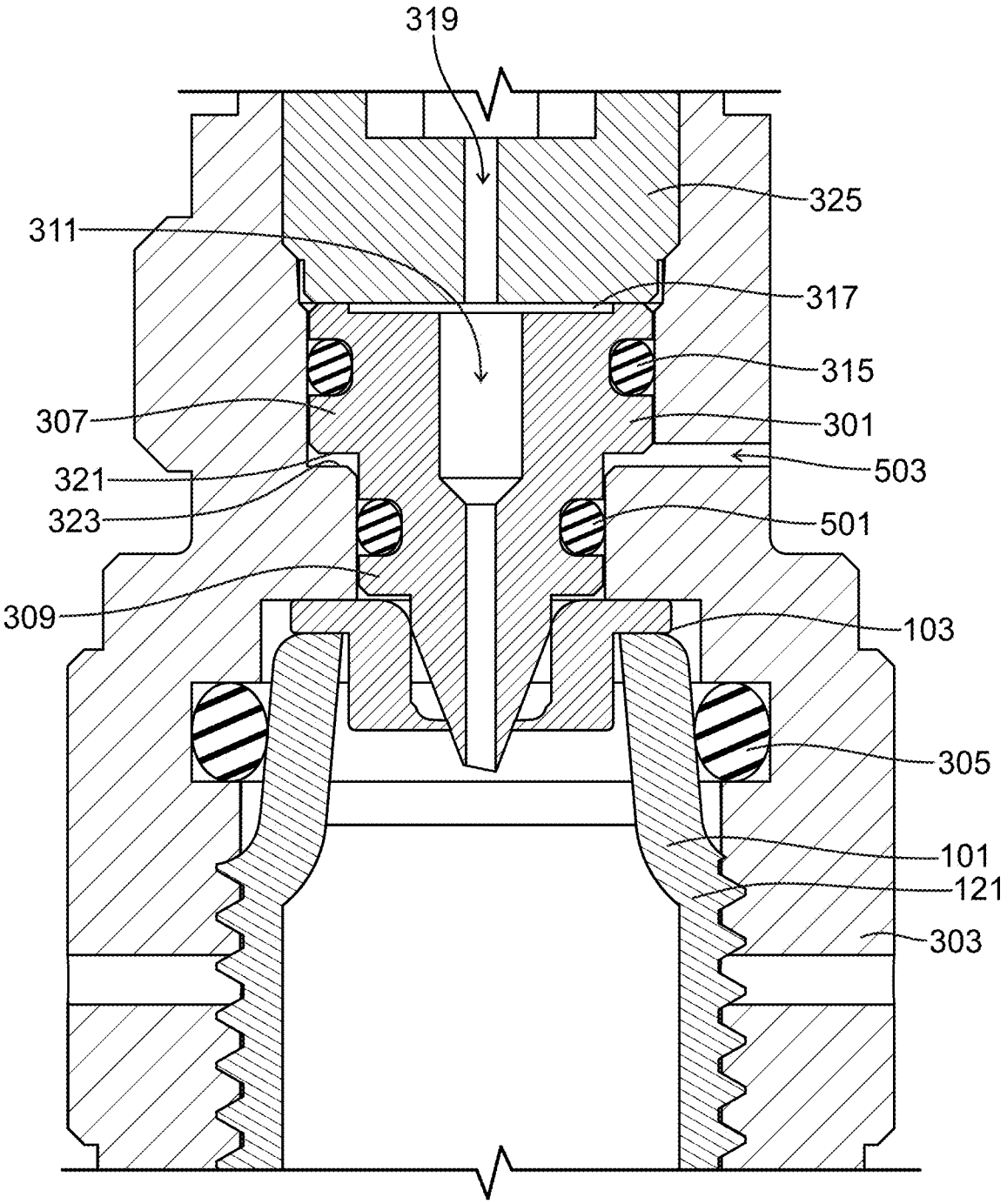
FIG. 6 is a side cutaway view of the neck of the pressure vessel of FIG. 1 inserted into a piercing mechanism with a movable pin and an atmospheric vent according to another embodiment of the invention.

Referring particularly to FIG. 6, in one embodiment, the piercing mechanism further includes a lower pin seal 501, and an atmospheric vent 503. The lower pin seal 501 is configured to seal between the pin 301 and the housing 303. The atmospheric vent 503 is through the housing between the upper pin seal 315 and the lower pin seal 501. The lower pin seal 501 and atmospheric vent 503 cooperate to prevent back pressure between the upper pin seal 315 and pressure vessel seal 305 which can limit downward travel of the pin 301 as pressure builds in the cavity 317. Back pressure between the upper pin seal 315 and pressure vessel seal 305 can also make it difficult to fully seat or screw in the pressure vessel 100 to the housing 303. In one embodiment, the lower pin seal 501 is configured to seal between the lower portion 309 of the pin 301 and the housing 303, and the lower pin seal 501 is below a stop 321 of the pin 301.

In one embodiment, the pin 301 includes stop 321. Stop 321 is a radial protrusion from the longitudinal passage 311. In one embodiment, the stop 321 is formed between the lower portion of the pin 309 and the upper portion of the pin 307. The housing 303 includes a seat 323 configured to contact the stop 321 such that the seat 323 and stop 321 cooperate to limit longitudinal movement of the pin 301 relative to the housing 303. In another embodiment, the housing 303 further includes a retainer 325 configured to limit longitudinal travel of the pin 301 to retain the pin 301 within the housing 303. In the embodiment of FIG. 5, the seat 323 is formed on the retainer 325 such that the retainer 325 limits downward travel of the pin 301. In the embodiment of FIG. 6, the retainer 325 limits upward movement of the pin 301 and the seat is built into a different portion of the housing 303. The retainer 325 may be interference fit, screwed in, or welded into the rest of the housing 303. In one embodiment, the components of the piercing mechanism are generally steel except for the seals which may be rubber, silicone, neoprene, or any other suitable material. The seals are generally o-rings but any other suitable shapes may be utilized such as double lip.

Figure 7:
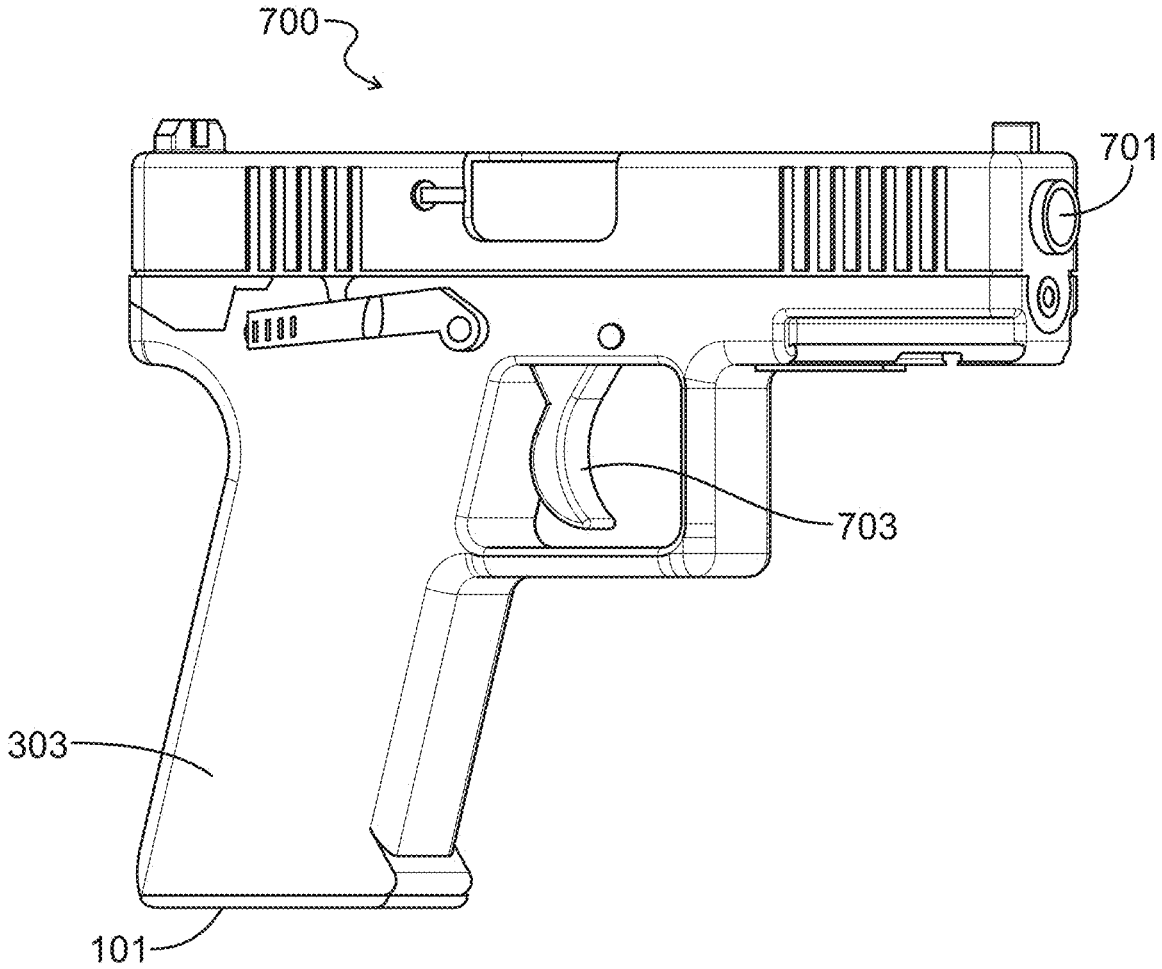
FIG. 7 is a side view of an airgun including the piercing mechanism of FIG. 6 and the pressure vessel of FIG. 1.

Referring particularly to FIG. 7, in one embodiment, an airgun 700 incorporates the piercing mechanism of FIG. 6. The airgun also includes a barrel 701, a trigger 703, and the pressure vessel 100. The barrel 701 is configured to launch a projectile from the barrel 701 when receiving pressurized gas. The trigger 703 is configured to selective release pressurized gas from the conduit 319 of the housing 303 to the barrel 701 such that the projectile is launched from the barrel 701.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention, it is not intended that such references be construed as limitations upon the scope of this invention except as set forth in the following claims.

What is claimed is:

1. A pressure vessel comprising:

a hollow body having exactly one opening; and a cap comprising:

a shoulder having a bottom surface configured to abut the hollow body about the opening in the hollow body when the pressure vessel is assembled, wherein the shoulder is generally planar having a hole therethrough;

a sidewall extending longitudinally and perpendicularly from the bottom surface of the shoulder about the hole, said sidewall having a central opening; and a membrane closing off the central opening, wherein the membrane is longitudinally offset from the shoulder;

wherein:

the sidewall extends into the opening of the hollow body when the pressure vessel is assembled such that the membrane is recessed into the hollow body;

the bottom surface of the shoulder is affixed to the hollow body about the opening of the hollow body when the pressure vessel is assembled; and the hollow body and cap cooperate to contain compressed nitrogen within the hollow body when the pressure vessel is assembled.

2. The pressure vessel of claim 1, wherein:

the pressure vessel contains compressed nitrogen when assembled.

3. The pressure vessel of claim 1, wherein:

the hole through the shoulder is generally circular;

the central opening is generally circular;

the shoulder is generally circular; and the membrane is generally circular.

4. The pressure vessel of claim 1, wherein:

the hollow body comprises a generally cylindrical main body extending longitudinally;

the hollow body comprises a neck extending from the main body to the opening, said neck having a smaller diameter than the main body; and the neck has threads thereon.

5. The pressure vessel of claim 1, wherein:

the central opening in the sidewall has a diameter equal to a dimeter of the hole in the shoulder.

6. The pressure vessel of claim 1, wherein:

the membrane is longitudinally thinner than the shoulder; and the membrane is longitudinally thinner than the sidewall is radially.

* * * * *